US007356293B2

(12) United States Patent
Mizumoto

(10) Patent No.: US 7,356,293 B2
(45) Date of Patent: Apr. 8, 2008

(54) TONER TRANSPORT ROLLER

(75) Inventor: Yoshihisa Mizumoto, Hyogo (JP)

(73) Assignee: Sumitomo Rubber Industries, Ltd., Kobe-shi (JP)

( * ) Notice: Subject to any disclaimer, the term of this patent is extended or adjusted under 35 U.S.C. 154(b) by 70 days.

(21) Appl. No.: 11/252,586

(22) Filed: Oct. 19, 2005

(65) Prior Publication Data

US 2006/0127125 A1 Jun. 15, 2006

(30) Foreign Application Priority Data

Dec. 9, 2004 (JP) ..... 2004-357345

(51) Int. Cl.
*G03G 15/08* (2006.01)

(52) U.S. Cl. ..... 399/286

(58) Field of Classification Search ..... 399/103, 399/176, 279, 286, 313, 357; 430/33, 48, 430/100, 120, 120.1; 492/56; 252/500, 252/502

See application file for complete search history.

(56) References Cited

U.S. PATENT DOCUMENTS 5,794,101 A * 8/1998 Watanabe et al. ..... 399/103
5,867,755 A * 2/1999 Sato ..... 399/286 X
6,574,444 B2 * 6/2003 Uehara et al. ..... 399/103
6,654,576 B2 * 11/2003 Dougherty ..... 399/103
6,690,900 B2 * 2/2004 Dougherty et al. ..... 399/103
2003/0118364 A1 6/2003 Kamimura
2004/0106708 A1 * 6/2004 Mizumoto et al. ..... 524/242
2004/0110617 A1 6/2004 Mizumoto
2004/0147383 A1 * 7/2004 Uesaka et al. ..... 492/56

FOREIGN PATENT DOCUMENTS

CN 1428664 A 7/2003
JP 2002-91158 A 3/2002
JP 2002-278386 A 9/2002
JP 2004-170845 A 6/2004

* cited by examiner

*Primary Examiner*—Sandra L. Brase
(74) *Attorney, Agent, or Firm*—Birch, Stewart, Kolasch & Birch, LLP

(57) ABSTRACT

A toner transport roller (10) including a sealing member (3), for preventing leak of toner, which contacts a peripheral surface of a rubber roller (1) thereof slidably. The toner transport roller (10) contains 3 to 50 parts by mass of alumina for 100 parts by mass of an ionic-conductive rubber and a loss tangent-adjusting filler. The annular sealing member (3) is slidably fitted on both ends of the rubber roller (1) in an axial direction thereof. It is preferable that the specific gravity of the ionic-conductive rubber is set to not less than 1.2.

17 Claims, 2 Drawing Sheets

TONER TRANSPORT ROLLER

This nonprovisional application claims priority under 35 U.S.C. § 119(a) on Patent Application No(s). 2004-357345 filed in Japan on Dec. 9, 2004, the entire contents of which are hereby incorporated by reference.

BACKGROUND OF THE INVENTION

1. Field of the Invention

The present invention relates to a toner transport roller having a sealing member, for preventing leak of toner, which contacts a peripheral surface of a rubber roller slidably. More particularly, present invention relates to the toner transport roller capable of restraining wear of a sealing portion thereof by efficiently dissipating heat generated by friction between the sealing member and the rubber roller when the sealing member slidably contacts the rubber roller and capable of preventing leak of toner. The toner transport roller is used preferably as a developing roller.

2. Description of the Related Art

In recent years, in the printing technique using the electrophotographic method, a high-speed printing operation, formation of a high-quality image, formation of a color image, and miniaturization of image-forming apparatuses have been progressively made and become widespread. Toner holds the key to these improvements. To satisfy the above-described demands, it is necessary to form finely divided toner particles, make the diameters of the toner particles uniform, and make the toner particles spherical. Regarding the technique of forming the finely divided toner particles, toner having a diameter not more than 10 μm and toner not more than 5 μm have been developed recently. Regarding the technique of making the toner spherical, toner having not less than 99% in its deviation from a spherical form has been developed. To form the high-quality image, polymerized toner has come to be widely used instead of pulverized toner conventionally used. The polymerized toner allows the reproduction of dots to be excellent in obtaining printed matters from digital information and hence a high-quality printed matter to be obtained.

In correspondence to the improvement in the technique of forming finely divided toner particles, making the diameters of the toner particles uniform, making the toner particles spherical, and the transition from the pulverized toner conventionally used to the polymerized toner, members constituting the image-forming apparatus adopting the electrophotographic method are demanded to have high-performance function and durability allowing the function of each member to be maintained to the last of the use life of the image-forming apparatus and the like.

To comply with such a demand, by mixing the loss tangent-adjusting filler with the ionic-conductive rubber uniform in its electrical characteristic, the present inventors have developed the conductive rubber roller (disclosed in Japanese Patent Application Laid-Open No.2004-170845 (patent document 1)) uniform in its electrical characteristic, superior in its property of electrically charging toner and the like, and capable of keeping the property of electrically charging the toner and the like.

The above-described conductive rubber roller is capable of keeping the charged amount of toner at a high level and is thus improving the transportability of the toner. But there is room for improvement for the durability of the conductive rubber roller.

To improve the durability of the rubber roller and allow it to display a high function reliably for a long time, it is important for the following rollers (described below) to faithfully transport toner which is very small and has a good shape to a subsequent member of an image-forming apparatus. The above-described rollers include a developing roller for supplying a certain amount of toner to a subsequent part of the image-forming apparatus, an electrophotographic photoreceptor, a transfer roller, and a cleaning roller for collecting toner which has not been transferred and remained on the transfer roller. It is also important for each member of the image-forming apparatus not to leak the toner to the inside thereof.

More specifically, the annular sealing member is slidably fitted on both axial ends of the rubber roller which transports the toner. Finely divided toner is liable to penetrate into a boundary partitioning the transport part and the non-transport part from each other, namely, the sliding-contact portion between the peripheral surface of the rubber roller and the inner peripheral surface of the sealing member. The spherical toner penetrates into the sliding-contact portion to a higher extent owing to its configuration. The penetration of the toner into the sliding-contact portion causes the rubber roller and the sealing member to contact each other through the toner. As a result, a high pressure is applied to the sliding-contact portion to generate heat violently. The generated heat causes the rubber roller and the sealing member to be worn to a high extent and the toner to leak in its turn. In the case of the polymerized toner, thermoplastic resin composing the toner melts. As a result, toner particles become large and edged and are welded to each other to form angular large particles. Thereby the rubber roller and the sealing member are destroyed acceleratedly. The peripheral surface of the rubber roller and the inner peripheral surface of the sealing member slide in contact with each other to generate heat. Thus even though the toner does not penetrate into the sliding-contact portion, the rubber roller and the sealing member are worn to generate a gap therebetween. Thereby the toner is liable to penetrate thereinto. The above-described problem will occur with time owing to the penetration of the toner thereinto.

The following inventions have been made to solve the above-described problem which occurs owing to the heat generated by the sliding contact between the rubber roller and the sealing member.

Disclosed in Japanese Patent Application Laid-Open No. 2002-91158 (patent document 2) is the one-component developing roller having the space formed inside the developing roller and the heat dissipation portion, formed at both ends of the developing roller, which allows communication between the outside air and the space.

In the description made in the specification, the above-described construction dissipates the heat generated at the portion of contact between the developing roller and the toner restriction member to the outside, thereby preventing the rise of temperature and aggregation and adherence of toner particles.

Disclosed in Japanese Patent Application Laid-Open No. 2002-278386 (patent document 3) is the image-forming apparatus having the developer agitation/transport member, disposed near the developing roller, which is composed of the highly thermal heat-conductive member such as a heat pipe. The image-forming apparatus further includes the heat dissipation (heat exchange) fin provided at the end of the developer agitation/transport member. According to the description made in the specification, this construction suppresses the influence of heat given by portions other than the image-forming portion and improves the cooling effect.

However, this construction causes the image-forming apparatus to be large and further the cooling speed to be differentiated in dependence on a flow speed of air and positions of members. Thus there is a possibility that some portions have a low toner transportability.

Patent document 1: Japanese Patent Application Laid-Open No. 2004-170845

Patent document 2: Japanese Patent Application Laid-Open No. 2002-91158

Patent document 3: Japanese Patent Application Laid-Open No. 2002-278386

SUMMARY OF THE INVENTION

It is an object of the present invention to provide a toner transport roller so constructed that a toner-leak prevention sealing member which slides along a peripheral surface of a rubber roller can be restrained from being worn and the leak of toner can be prevented.

To achieve the object, the present invention provides a toner transport roller having a sealing member, for preventing leak of toner, which contacts a peripheral surface of a rubber roller thereof slidably. The toner transport roller contains three to 50 parts by mass of alumina for 100 parts by mass of an ionic-conductive rubber and a loss tangent-adjusting filler.

In the toner transport roller, the annular sealing member is slidably fitted on both ends of the rubber roller in an axial direction thereof.

As described above, in the toner transport roller containing the alumina having an excellent thermal conduction, it is possible to quickly disperse heat generated by sliding-contact friction between the sealing member and the peripheral surface of the rubber roller containing the alumina to the entire rubber roller. It is possible to escape heat transmitted to the inside of the rubber roller to the outside via the core made of metal and dissipate the heat from the surface of the rubber roller containing the alumina. Therefore it is possible to inhibit wear of the sealing member accelerated by the heat generated by the sliding-contact friction between the sealing member and the rubber roller and prevent the leak of the toner effectively for a long time. Because the rubber roller is not heated to a high temperature by the heat generated by the sliding-contact friction between the sealing member and the rubber roller, it is possible to prevent thermoplastic resin composing the polymerized toner from being fused. Thereby it is possible to prevent the polymerized toner particles from becoming large or edged and being welded to each other and hence the generation of large angular particles. Therefore it is possible to improve the durability of the sealing member and the rubber roller to a very high extent.

Alumina is an oxide ($Al_2O_3$) of aluminum. The toner transport roller contains 3 to 50 parts by mass of the alumina, favorably 5 to 30 parts by mass thereof, and more favorably 8 to 25 parts by mass for 100 parts by mass of the ionic-conductive rubber. The reason the toner transport roller contains 3 to 50 parts by mass of the alumina is as follows: If the toner transport roller contains less than three parts by mass of the alumina, it is difficult to obtain the effect of escaping the heat generated by the sliding-contact friction between the sealing member and the rubber roller to the outside. On the other hand, if the toner transport roller contains more than 50 parts by mass of the alumina, the hardness of the rubber roller increases and thus becomes too hard and further the deterioration of the toner is accelerated. Furthermore the durability of an abrasive material for abrading the surface of the rubber roller deteriorates. Thus redressing is required. When the toner transport roller contains less than 30 parts by mass of alumina, the alumina and the loss tangent-adjusting filler mix favorably with each other.

It is favorable that not less than 80% of the entire alumina particles to be used in the present invention have diameters not more than 1 μm and more favorable that not less than 50% of the entire alumina particles have diameters not more than 0.5 μm. The alumina having small diameters can be dispersed uniformly, thus improving a heat dissipation effect and allowing the surface of the rubber roller to be uniform.

As the ionic-conductive rubber that is used in the present invention, various unsaturated rubbers or thermoplastic rubbers can be used as copolymerized rubber and blended rubber.

More specifically, it is possible to use epihalohidrin rubber (epichlorohidrin rubber), polyether rubber, acrylonitrile rubber, acrylonitrile butadiene rubber, chloroprene rubber, butadiene rubber, styrene butadiene rubber, butyl rubber, fluororubber, isoprene rubber, and silicone rubber. These ionic-conductive rubbers can be used singly or in combination of two or more of them.

Ethylene oxide-containing rubber is preferable as the ionic-conductive rubber to be used in the present invention. Polyether polymer and epichlorohidrin rubber can be used as the ethylene oxide-containing rubber.

As the polyether polymer, it is possible to use an ethylene oxide-propylene oxide-allyl glycidyl ether copolymer, an ethylene oxide-allyl glycidyl ether copolymer, a propylene oxide-allyl glycidyl ether copolymer, an ethylene oxide-propylene oxide, and urethane rubber.

As the epichlorohidrin rubber, it is possible to use epichlorohidrin (EP) homopolymerized rubber, an epichlorohidrin-ethylene oxide copolymer, an epichlorohidrin-propylene oxide copolymer, an epichlorohidrin-allyl glycidyl ether copolymer, an epichlorohidrin-ethylene oxide-allyl glycidyl ether copolymer, an epichlorohidrin-propylene oxide-allyl glycidyl ether copolymer, and an epichlorohidrin-ethylene oxide-propylene oxide-allyl glycidyl ether copolymer.

It is preferable to use rubber containing the epichlorohidrin rubber as its main component as the ionic-conductive rubber to be used in the present invention. When the epichlorohidrin rubber and other rubber components are combined with each other, it is preferable to add not less than 20 parts by mass and less than 100 parts by mass of the epichlorohidrin rubber to 100 parts by mass of the rubber component.

As other rubbers to be combined with the epichlorohidrin rubber, it is possible to use rubber such as acrylonitrile-butadiene rubber (NBR) and chloroprene having a comparatively high resistance and a polymer having a low electric resistance. As the polymer having a low electric resistance, it is possible to use a bipolymer of ethylene oxide and unsaturated epoxide, a bipolymer of propylene oxide and unsaturated epoxide, and terpolymer of ethylene oxide, propylene oxide, and unsaturated epoxide. As the unsaturated epoxide, it is possible to use allyl glycidyl ether, glycidyl methacrylate, glycidyl acrylate, and butadiene monoxide.

As other rubbers to be combined with the epichlorohidrin rubber, chloroprene rubber or/and an ethylene oxide (EO)-propylene oxide (PO)-allyl glycidyl ether (AGE) copolymer (hereinafter referred to as EO-PO-AGE copolymer) is preferable. Blended rubber of the epichlorohidrin rubber, the chloroprene rubber, and the EO-PO-AGE copolymer is superior in its wear resistance. Thus conjointly with the improvement of the wear resistance of the toner transport roller brought about by the addition of alumina to the ionic-conductive rubber, the addition of the blended rubber of the epichlorohidrin rubber, the chloroprene rubber, and the EO-PO-AGE copolymer to the ionic-conductive rubber prevents the leak of toner effectively. The copolymerization ratio among the components of the blended rubber is not specifically restricted but can be appropriately selected. For example, the copolymerization weight ratio among the epichlorohidrin rubber, the chloroprene rubber, and the EO-PO-AGE copolymer is 2-5:4 to 7:1 and favorably 3 to 4:5 to 6:1 respectively. Regarding the wear resistance of the rubbers, the wear resistance of the blended rubber of the epichlorohidrin rubber, the chloroprene rubber, and the EO-PO-AGE copolymer is higher than that of the epichlorohidrin rubber. The wear resistance of the epichlorohidrin rubber is higher than that of the blended rubber of the epichlorohidrin rubber and the chloroprene rubber.

It is preferable that the ionic-conductive rubber to be used in the present invention has a specific gravity not less than 1.2.

When the specific gravity of the ionic-conductive rubber is not less than 1.2, it has a comparatively large heat capacity. Thus it has a large calorific value.

The rubber roller containing the alumina having a large calorific value has an outstanding heat dissipation effect displayed by the alumina, thus reducing the wear of the sealing member more effectively than the rubber roller not containing the alumina.

The larger the specific gravity, the larger the heat capacity and the calorific value. Thus the specific gravity of the ionic-conductive rubber is favorably not less than 1.35 and more favorably not less than 1.4. It is preferable that the upper limit of the specific gravity of the ionic-conductive rubber is 1.6.

It is favorable that weakly conductive carbon black or/and calcium carbonate treated with fatty acid are used as the loss tangent-adjusting filler to be contained in the rubber roller. By adding these components to the ionic-conductive rubber, the rubber roller is capable of providing a much lower loss tangent than the conventional rubber composition containing the ionic-conductive rubber without deteriorating the ionic conductivity of the rubber composition. As the loss tangent-adjusting filler, it is possible to use clay, organic/inorganic pigments, and the like.

The weakly conductive carbon black has a large diameter, a low extent of development in its structure, and a small degree of contribution to the conductivity of the rubber roller. The rubber roller containing the weakly conductive carbon black is capable of obtaining a capacitor-like operation owing to a polarizing action without increasing the conductivity thereof and controlling an electrostatic property of the rubber roller without deteriorating the uniformity of the electric resistance thereof.

Various weakly conductive carbon blacks can be selected. For example, it is favorable to use carbon black produced by a furnace method or a thermal method providing particles having large diameters. It is most favorable to use the carbon black produced by the thermal method because the thermal method produces the carbon black containing little impurities. SRF carbon, FT carbon, and MT carbon are preferable in terms of classification of carbon. The carbon black for use in pigment may be used.

It is favorable that the average diameter of the weakly conductive carbon black is in the range of 100 nm to 500 nm. The weakly conductive carbon black having the above-described diameter does not inhibit the dispersion of the alumina and has an affinity for the alumina in a favorable dispersion of the weakly conductive carbon black and the alumina.

The calcium carbonate treated with fatty acid is more active than ordinary calcium carbonate and is lubricant because the fatty acid is present on the interface of the calcium carbonate. Thus a high degree of the dispersion of the calcium carbonate treated with the fatty acid can be realized easily and reliably. When the polarization action is accelerated by the treatment of the calcium carbonate with the fatty acid, there is an increase in the capacitor-like operation of the rubber layer. Thus the loss tangent can be efficiently reduced.

The mixing amount of the loss tangent-adjusting filler in the rubber roller of the present invention should be selected in such a way that the loss tangent thereof is in the range of 0.1 to 1.5 when an alternating voltage of 5V is applied thereto at a frequency of 100 Hz. The loss tangent which is one of the electrical characteristics of the rubber roller means an index indicating the flowability of electricity (conductivity) and the degree of influence of a capacitor component (electrostatic capacity). In other words, the loss tangent is a parameter indicating a phase delay when an alternating current is applied to the rubber roller, namely, the rate of the capacitor component when a voltage is applied to the rubber roller. When the loss tangent is large, it is easy to energize (electric charge) the rubber roller, which makes the progress of polarization slow. On the other hand, when the loss tangent is small, it is not easy to energize the rubber roller, which makes the progress of polarization fast. By setting the loss tangent to the above-described range of 0.1 to 1.5, the polarization of the toner transport roller can be set to an optimum range. Thus it is possible to impart electrostatic property to toner without deteriorating the uniformity of the electric resistance of the toner transport roller and maintain the electrostatic property imparted thereto.

It is difficult to realize the loss tangent less than 0.1 by ionic conduction. If the loss tangent is more than 1.5, it is impossible to provide the toner transport roller with the above-described preferable electrostatic property. It is more favorable that the loss tangent of the toner transport roller of the present invention is set to the range of 0.2 to 1.0.

More specifically, when the weakly conductive carbon black is used as the loss tangent-adjusting filler, it is favorable that not less than 5 nor more than 70 parts by mass of the weakly conductive carbon black is added to 100 parts by mass of the rubber component. It is possible to reduce the loss tangent while maintaining an ionic-conductive state by setting the amount of the weakly conductive carbon black to the above-described range, although a proper amount of the weakly conductive carbon black varies in dependence on the kind thereof. It is more favorable that not less than 25 nor more than 55 parts by mass of the weakly conductive carbon black is added to 100 parts by mass of the rubber component so that the weakly conductive carbon black has an affinity for the alumina in the favorable dispersion of the weakly conductive carbon black and the alumina.

When the calcium carbonate treated the fatty acid is used as the loss tangent-adjusting filler, it is favorable that not less than 30 nor more than 80 parts by mass of the calcium carbonate treated with the fatty acid is added to 100 parts by mass of the rubber component. If less than 30 parts by mass of the calcium carbonate treated with the fatty acid is added to 100 parts by mass of the rubber component, the degree of influence on the loss tangent is low. Thus, it is difficult to reduce the loss tangent. On the other hand, if more than 80 parts by mass of the calcium carbonate treated with the fatty acid is added to 100 parts by mass of the rubber component, it is possible to control the loss tangent. But the hardness of the rubber composition is liable to increase and the electric resistance value thereof is liable to fluctuate. It is more favorable that not less than 40 nor more than 70 parts by mass of the calcium carbonate treated with the fatty acid is added to 100 parts by mass of the rubber component.

It is preferable that the mixing amount of the loss tangent-adjusting filler is larger than that of the alumina. When the weakly conductive carbon black is used as the loss tangent-adjusting filler, the mixing amount of the weakly conductive carbon black is set larger than that of the alumina.

Both an electric resistance R100 of the toner transport roller in an application of 100V and an electric resistance R500 thereof in an application of 500V are favorably within a range of $10^5$ to $10^8$ and more favorably within a range of $10^5$ to $10^7$.

If the electric resistance of the toner transport roller is less than $10^5$, too much electric current flows and hence a defective image is liable to be formed. Further there is a possibility of discharge. On the other hand, if the electric resistance of the toner transport roller is more than $10^8$, a voltage fluctuation becomes too large when toner flies in an environment having a low temperature and a low humidity.

It is preferable that the following relationship establishes between the electric resistance R100 of the toner transport roller in the application of 100V and the electric resistance R500 thereof in the application of 500V:

$$\log R100 - \log R500 < 0.5$$

By specifying the difference between the reference electric resistance value of the toner transport roller in the application of 500V close to a developing bias, it is possible to make the electrical characteristic thereof such as the electric resistance uniform. It is favorable that the toner transport roller is ionic-conductive because the ionic-conductive toner transport roller depends on a voltage to a low extent. In the case where the toner transport roller is dependent on electronic conduction by containing the ordinary carbon black and the like, the value of (log R100−log R500) is not less than 1.

It is favorable that the surface roughness Rz of the toner transport roller is not less than 1 μm nor more than 8 μm. If the surface roughness Rz of the toner transport roller is less than 1 μm, it is difficult to transport toner. On the other hand, if the surface roughness Rz of the toner transport roller is more than 8 μm, the toner is collected in concavities of the surface of the toner transport roller. Thus the toner is liable to be transported nonuniforinly. It is more favorable that the surface roughness Rz of the toner transport roller is not more than 10 μm.

It is preferable that the friction coefficient of the surface of the toner transport roller is in the range of 0.1 to 1.5. In this range, it is possible to charge the toner to a high extent, prevent the toner from sticking to the surface of the toner transport roller, and reduce the calorific value at the sealing portion. If the friction coefficient of the surface of the toner transport roller is more than 1.5, a large stress such as a large shearing force is applied to the toner. On the other hand, if the friction coefficient of the surface of the toner transport roller is less than 0.1, the toner slips and hence it is difficult to transport a sufficient amount of toner.

The toner transport roller of the present invention can be used as various rollers which require the function of transporting the toner by holding it on the surface thereof. More specifically, the toner transport roller of the present invention can be used as a developing roller, an electrophotographic photoreceptor, a transfer belt, and a cleaning roller of an image-forming apparatus.

The toner transport amount of the toner transport roller of the present invention is not limited to a specific amount, but it is preferable that the toner transport roller is capable of transporting the toner in an amount of 0.01 to 1.0 mg/cm$^2$.

The toner transport roller of the present invention has the sealing member for preventing the leak of the toner. It is unnecessary to adhere to the name of the sealing member, but a toner transport roller having a member which slidably contacts the peripheral surface thereof is included in the scope of the present invention. For example, a cleaning roller having a toner collection apparatus mounted in contact with the rubber roller, a charging roller having a cleaner, and a transfer roller are included in "toner transport roller having the sealing member" of the present invention. Effect of the Invention In the toner transport roller containing the alumina having a superior thermal conduction, it is possible to quickly disperse the heat generated by the sliding-contact friction between the sealing member and the peripheral surface of the rubber roller to the entire rubber roller and escape the heat to the outside. Therefore it is possible to inhibit the wear of the sealing member accelerated by the heat generated owing to the sliding-contact friction between the sealing member and the rubber roller and prevent the leak of the toner effectively for a long time.

Because the toner transport roller is not heated to a high temperature by the heat generated owing to the sliding-contact friction between the sealing member and the rubber roller, it is possible to prevent thermoplastic resin composing the polymerized toner from being fused. Thereby it is possible to prevent the polymerized toner particles from becoming large or edged and being welded to each other and hence the generation of large angular particles. Therefore it is possible to improve the durability of the sealing member to a very high extent.

When the rubber composing the toner transport roller has a low degree of wearability, the sealing portion is liable to be worn. But it is possible to improve the rubber having a low degree of wearability by adding the alumina thereto. Thereby it is possible to restrain the sealing member from being worn and hence improve the durability of the sealing member.

Because the toner transport roller of the present invention has the property of retaining electrons owing to the alumina contained therein, the toner transport roller is capable of efficiently charging toner with electricity and has an excellent toner transportability. A fogged image is generated when the toner is charged at not more than 10 μC/g. When the toner transport roller of the present invention is used as a developing roller, it is capable of charging the toner with electricity for a long time. Thereby it is possible to restrain the generation of the fogged image.

DETAILED DESCRIPTION OF THE PREFERRED EMBODIMENTS

The embodiments of the present invention will be described below with reference to drawings.

Figure 1:
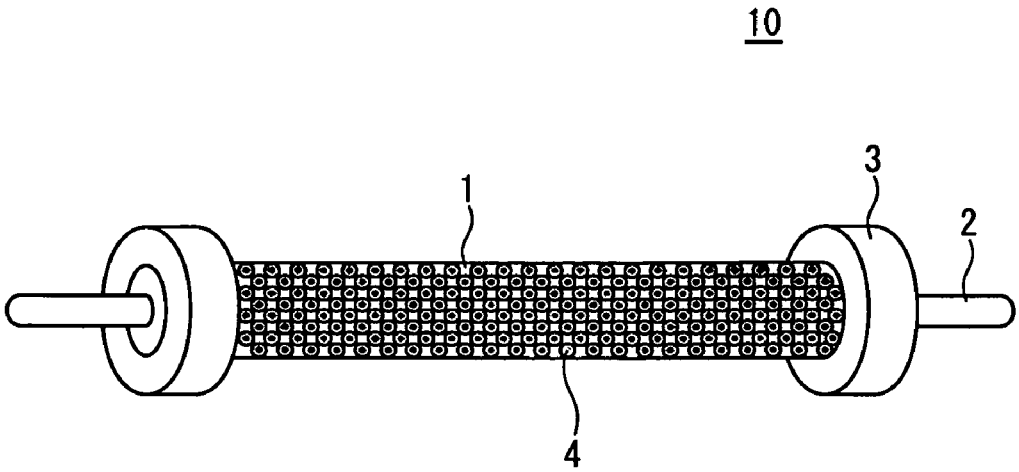
FIG. 1 is a schematic view showing a toner transport roller of the present invention.

As shown in FIG. 1, a toner transport roller 10 of the present invention has a cylindrical rubber roller 1 having a thickness of 0.5 mm to 15 mm (10 mm in this embodiment), a columnar core 2, having a diameter of 10 mm, which is inserted into a hollow portion of the rubber roller 1 by press fit, and a pair of annular sealing members 3 for preventing leak of toner 4. The sealing members 3 are slidably fitted on the rubber roller 1 at both ends thereof in the axial direction thereof.

The rubber roller 1 and the core 2 are bonded to each other with a conductive adhesive agent. The core 2 is made of metal such as aluminum, aluminum alloy, SUS, and iron or ceramics.

The sealing member 3 is made of nonwoven cloth such as Teflon (registered trade mark) or a sheet.

The reason the thickness of the rubber roller 1 is set to 0.5 mm to 15 mm is as follows: If the thickness of the rubber roller 1 is less than 0.5 mm, it is difficult to obtain an appropriate nip. If the thickness of the rubber roller 1 is larger than 15 mm, the toner transport roller 10 is so large that it is difficult to reduce the size and weight of an apparatus in which the toner transport roller 10 is mounted.

As the ionic-conductive rubber serving as the rubber roller 1, epichlorohidrin rubber is used. It is possible to use blended rubber of the epichlorohidrin rubber and chloroprene rubber (blending ratio: 1:1), and blended rubber of the epichlorohidrin rubber, the chloroprene rubber, and EO-PO-AGE copolymer (blend at a ratio 4:5:1).

As the above-described epichlorohidrin rubber, it is preferable to use an epichlorohidrin-ethylene oxide bipolymer or an epichlorohidrin-ethylene oxide-allyl glycidyl ether terpolymer. Above all, it is preferable to use the epichlorohidrin rubber in which the epichlorohidrin, the ethylene oxide, and the allyl glycidyl ether are copolymerized at favorably 45 to 10 mol %, 50 to 80 mol %, and 0 to 10 mol % respectively, more favorably 40 to 20 mol %, 55 to 75 mol %, and 0 to 10 mol % respectively, and most favorably 40 mol %, 56 mol %, and 4 mol % respectively.

As the EO-PO-AGE copolymer to be combined with the epichlorohidrin rubber, it is preferable to use the EO-PO-AGE copolymer in which the EO, the PO, and the AGE are copolymerized at 90:4:6.

The rubber roller 1 contains 3 to 50 parts by mass of alumina for 100 parts by mass of the above-described ionic-conductive rubber. The alumina is added to the ionic-conductive rubber at favorably 5 to 30 parts by mass and more favorably 8 to 25 parts by mass. To improve the dispersibility of the alumina, it is preferable that 91% of the entire alumina particles has diameters not more than 1 μm and 64% of the entire alumina particles has diameters not more than 500 nm.

The rubber roller 1 further contains a loss tangent-adjusting filler. As the loss tangent-adjusting filler, weakly conductive carbon black or calcium carbonate treated with fatty acid is used. It is preferable to use the weakly conductive carbon black because it has an affinity for the alumina in a favorable dispersion of the weakly conductive carbon black and the alumina and thus does not inhibit the dispersion of the alumina. When the calcium carbonate treated with the fatty acid is used, it is necessary to take care because the calcium carbonate treated with the fatty acid has a good affinity for the alumina and there is a possibility that it aggregates partly to grow into a big particulate foreign body.

To allow the weakly conductive carbon black to have an affinity for the favorable dispersion of the weakly conductive carbon black and the alumina, the particle diameter of the weakly conductive carbon black is 100 to 500 nm and favorably 120 nm. To allow the loss tangent of the toner transport roller of the present invention to have an appropriate value in the range of 0.1 to 1.5, the mixing amount of the weakly conductive carbon black is set to 5 to 70 parts by mass for 100 parts by mass of the ionic-conductive rubber. To mix the weakly conductive carbon black with the alumina favorably, the mixing amount of the weakly conductive carbon black is favorably 25 to 55 parts by mass and more favorably 40 parts by mass for 100 parts by mass of the ionic-conductive rubber.

The mixing amount of the calcium carbonate treated with fatty acid is set to 30 to 80 parts by mass for 100 parts by mass of the ionic-conductive rubber to allow the loss tangent of the toner transport roller 1 of the present invention to have an appropriate value of 0.1 to 1.5. To favorably mix the calcium carbonate treated with the fatty acid with alumina, the mixing amount of the calcium carbonate treated with the fatty acid is favorably 40 to 70 parts by mass and more favorably 50 parts by mass for 100 parts by mass of the ionic-conductive rubber.

In addition to the above-described essential components, the toner transport roller 1 may contain the following additives unless the use thereof is not contradictory to the object of the present invention: a vulcanizing agent, a vulcanizing accelerating agent, a vulcanizing accelerating assistant agent, an inorganic filler, a acid-accepting agent, a softening agent, an age resistor, an antioxidant, an ultraviolet ray absorber, a lubricant, a pigment, an antistatic agent, a fire retardant, counteractive, a plasticizer, a core-forming agent, a foam prevention agent, and a crosslinking agent. The toner transport roller 1 of the present invention contains the vulcanizing agent.

As the vulcanizing agent the toner transport roller 1 is capable of containing includes sulfur-based vulcanizing agent, triazine derivatives, thiourea-based vulcanizing agent, and monomers. These vulcanizing agents can be used singly or in combination of two or more of them. As the sulfur-based vulcanizing agent, it is possible to use powdered sulfur, an organic sulfur-containing compounds such as tetramethylthiuram disulfide, N,N-dithiobismorpholine, and the like. As the thiourea-based vulcanizing agent, it is possible to use tetramethylthiourea, trimethylthiourea, ethylenethiourea, and thioureas shown by $(CnH2n+1NH)_2C{=}S$ (n=integers 1 to 10) singly or in combination. Above all, it is preferable to use the powdered sulfur and the ethylene thiourea in combination.

The addition amount of the vulcanizing agent is favorably not less than 0.5 nor more than five parts by mass and more favorably not less than one nor more than three parts by mass for 100 parts by mass of the rubber component.

When halogen-containing rubber such as epichlorohidrin rubber is used as the ionic-conductive rubber of the toner transport roller 1, a acid-accepting agent is used at favorably not less than 0.5 nor more than 10 parts by mass and more favorably not less than 1.0 nor more than 8.0 parts by mass for 100 parts by mass of the halogen-containing rubber.

If the mixing amount of the acid-accepting agent is less than 0.5 parts by mass, it is difficult to obtain the effect of preventing vulcanization inhibition and contamination of other members. On the other hand, if the mixing amount of the acid-accepting agent is more than 5.0 parts by mass, the hardness of the rubber roller is liable to become high. As the acid-accepting agent, hydrotalcites and magsarat are favorable are preferable because they have preferable dispersibility. As the acid-accepting agent, it is also possible to use various substances acting as an acid acceptor.

It is preferable that the surface of the rubber roller 1 is formed as an oxide film. It is preferable that the oxide film has a large number of C═O groups or C—C groups. The oxide film is effective in that it is capable of decreasing the friction coefficient of the toner transport roller and adjusting the loss tangent thereof. The oxide film can be formed on the surface of the rubber roller by irradiating the surface thereof with ultraviolet rays and/or ozone and oxidizing the rubber roller. It is preferable to form the oxide film on the surface of the rubber roller by irradiating the surface thereof with ultraviolet rays because the use of the ultraviolet rays allows a treating period of time to be short and the oxide film-forming cost to be low. The treatment for forming the oxide film can be made in accordance with a known method. For example, ultraviolet rays having a wavelength of 100 nm to 400 nm and favorably 100 nm to 200 nm is used for 30 seconds to 30 minutes and favorably one to 10 minutes, although the wavelength of the ultraviolet rays varies according to the distance between the surface of the rubber roller and an ultraviolet ray irradiation lamp and the kind of rubber. The intensity of the ultraviolet rays and irradiation conditions (time, temperature inside tank, distance) are selected within a range which allows the loss tangent and the friction coefficient of the toner transport roller of the present invention to be obtained.

Supposing that an electric resistance of the rubber roller is R50 when a voltage of 50V is applied thereto before the oxide film is formed and that an electric resistance thereof is R50*a* when a voltage of 50V is applied thereto after the oxide film is formed, it is favorable that log R50*a*−log R50=0.2 to 1.5. When the value of the equation log R50*a*−log R50 is less than 0.2, it is difficult to obtain a low friction coefficient and improve the durability of the toner transport roller. On the other hand, when the value of the equation log R50*a*−log R50 is larger than 1.5, the electric resistance changes greatly when the toner transport roller is in operation. Thus a preferable electrostatic characteristic cannot be obtained. The electric resistance of the toner transport roller at the time when a low voltage of 50V can be stably applied thereto is set as the index value. Thus it is possible to accurately capture a slight rise of the electric resistance caused by the formation of the oxide film. It is more favorable that log R50*a*−log R50=0.5 to 1.2.

The toner transport roller of the present invention can be formed by conventional methods. For example, after components composing the toner transport roller are kneaded by a Banbury mixer, the mixture of the kneaded components is preformed tubularly by using a rubber extruder. After the preformed material is vulcanized at 160° C. for 15 to 70 minutes, a core was inserted into the tubularly preformed material and bonded thereto. After the surface of the tubularly preformed material was abraded, it was cut to a required dimension. Thereafter the cut piece was abraded appropriately to form the cut piece into a roller. The vulcanizing period of time should be determined by finding an optimum vulcanizing period of time by using a rheometer (for example, Curelastometer) which is used in a vulcanization test. The vulcanizing temperature can be set to a temperature in the vicinity of the above-described temperature. To reduce contamination of other members and a compression set, it is preferable to set conditions in which a sufficient vulcanization amount can be obtained. A foamed roller may be formed by adding a blowing agent to the ionic-conductive rubber.

After the rubber roller was washed with water, an oxide film is formed on the surface thereof. More specifically, by using an ultraviolet ray irradiator, the surface of the rubber roller spaced at 10 cm from the ultraviolet ray irradiator was irradiated with ultraviolet rays (wavelength: 184.9 nm and 253.7 nm) for five minutes in the range of 90 degrees in the circumferential direction thereof. The rubber roller was rotated by 90 degrees four times to form the oxide film on the entire peripheral surface (360 degrees) thereof.

In the toner transport roller obtained in the above-described method, the range of an electric resistance R100 of the toner transport roller in an application of 100V is 6≦log R100≦6.1, and the range of an electric resistance R500 thereof in an application of 500V is 5.9≦log R500≦6. The surface roughness Rz of the toner transport roller is set to not less than 1.0 μm nor more than 8.0 μm. The friction coefficient of the surface of the toner transport roller is set to 0.3 to 1.0.

Printing was made by forming a 1% image on a plurality of sheets of paper by using the toner transport roller of the present invention as a developing roller. When printing was made on 7,500 sheets of paper, toner was present on the front face of the sealing portion. When printing was made on 8,000 sheets of paper, a fogged image was generated. The toner did not penetrate into the sealing portion.

Examples of the toner transport roller of the present invention and toner transport rollers of comparison examples will be described below.

TABLE 1

| | Example 1 | Example 2 | Example 3 | Example 4 | Example 5 | Example 6 | Example 7 | Example 8 |
|---|---|---|---|---|---|---|---|---|
| Epichlorohidrin rubber | 100 | 100 | 100 | 100 | 100 | 100 | 100 | 100 |
| Alumina | 3 | 5 | 8 | 12 | 20 | 25 | 45 | 10 |
| Calcium carbonate treated with fatty acid | | | | | | | | 50 |
| weakly conductive carbon black | 40 | 40 | 40 | 40 | 40 | 40 | 40 | |
| Surface roughness (Rz) | 3.9 | 3.8 | 4 | 3.8 | 3.9 | 3.9 | 3.9 | 3.9 |
| Resistance of roller (500 V; value in logarithm) | 5.9 | 5.9 | 6 | 6 | 6 | 6 | 6 | 6 |

TABLE 1-continued

| | | | | | | | | |
|---|---|---|---|---|---|---|---|---|
| Resistance of roller (100 V; value in logarithm) | 6 | 6 | 6.1 | 6.1 | 6.1 | 6.1 | 6.1 | 6.1 |
| friction coefficient | 0.8 | 0.8 | 0.7 | 0.6 | 0.6 | 0.6 | 0.6 | 1 |
| Wear of sealing portion | | | | | | | | |
| Number of sheets of paper | 9,000 | 9,500 | 10,000 | 11,000 | 10,000 | 10,000 | 9,000 | 8,500 |
| Evaluation | ○ | ○ | ◎ | ◎ | ◎ | ◎ | ○ | ○ |
| Generation of fogged image | | | | | | | | |
| Number of sheets of paper | 8,000 | 8,000 | 9,000 | 9,000 | 9,000 | 8,000 | 8,000 | 7,500 |
| Evaluation | ○ | ○ | ○ | ○ | ○ | ○ | ○ | Δ |
| Synthetic evaluation | ○ | ○ | ○~◎ | ○~◎ | ○~◎ | ○~◎ | ○ | ○ |

| | Comparison Example 1 | Comparison Example 2 | Comparison Example 3 |
|---|---|---|---|
| Epichlorohidrin rubber | 100 | 100 | 100 |
| Alumina | | | 55 |
| Calcium carbonate treated with fatty acid | | 50 | |
| weakly conductive carbon black | 40 | | 40 |
| Surface roughness (Rz) | 4 | 3.5 | 4 |
| Resistance of roller (500 V; value in logarithm) | 6 | 6 | 6 |
| Resistance of roller (100 V; value in logarithm) | 6.1 | 6.1 | 6.1 |
| friction coefficient | 0.8 | 1 | 0.6 |
| Wear of sealing portion | | | |
| Number of sheets of paper | 7,000 | 7,000 | 7,500 |
| Evaluation | Inflow of toner | Inflow of toner | Inflow of toner |
| Generation of fogged image | | | |
| Number of sheets of paper | 8,000 | 7,000 | 7,000 |
| Evaluation | ○ | Δ | Δ |
| Synthetic evaluation | Δ | Δ | Δ |

Components of the toner transport rollers of the examples and the comparison examples are as described below.

As the rubber component, epichlorohidrin rubber ("epichlomer CG102" produced by Daiso Inc.) was used. The rubber component was an epichlorohidrin polymer in which ethylene oxide (EO), epichlorohidrin (EP), and allyl glycidyl ether (AGE) were copolymerized at 56 mol %, 40 mol %, and 4 mol % respectively. The epichlorohidrin rubber had a specific gravity of 1.24.

In the examples 1 through 7 and the comparison examples 1 and 3, the weakly conductive carbon black ("Asahi #15" produced by Asahi Carbon Inc., average diameter of primary particle: 120 nm) was used as the loss tangent-adjusting filler. In the example 8 and the comparison example 2, calcium carbonate treated with fatty acid ("Hakuenka CC" produced by Shiraishi Calcium Inc.) was used as the loss tangent-adjusting filler.

Alumina ("AL-160SG-1" produced by Shaowa Denko Inc.) was used. 91% of the entire alumina particles had diameters not more than 1 μm. 64% of the entire alumina particles had diameters not more than 500 nm.

Although not shown in table, the following substances were used. 0.5 parts by mass of sulfur was added to 100 parts by mass of the rubber component as the vulcanizing agent. 1.4 parts by mass of ethylene thiourea ("Accel 22-S" produced by Kawaguchi Kagaku) was added to 100 parts by mass of the rubber component. Three parts by mass of hydrotalcite ("DHT-4A-2" produced by Kyowa Kagaku Kogyo Inc.) was added to 100 parts by mass of the rubber component as the acid-accepting agent.

The method of manufacturing the toner transport rollers of the examples and the comparison examples is described below.

After components shown in table 1 were kneaded by a Banbury mixer, the kneaded components were extruded by an extruder to obtain a tube having an outer diameter of ϕ22 mm and an inner diameter of ϕ9 to 9.5 mm. The tube was mounted on a shaft, having a diameter of ϕ8 mm, for vulcanizing use. After the rubber component was vulcanized by a vulcanizing can at 160° C. for one hour, the tube was mounted on a shaft, having a diameter of ϕ10 mm, to which an electroconductive adhesive agent was applied. The tube and the shaft were bonded to each other in an oven having a temperature of 160° C. After the end of each of the obtained rubber roller was cut and molded, the surface thereof was perform traverse polishing and polishing to a mirror-like surface as a finish polishing by using a cylindrical polishing machine so that each rubber roller had a predetermined surface roughness Rz at 3 to 5 μm specified in JIS B 0601. As a result, the toner transport roller having ϕ 20 mm (tolerance: 0.05) was obtained.

After the rubber roller was washed with water, the surface thereof was irradiated with-ultraviolet rays to form an oxide film on the surface thereof. More specifically, by using an ultraviolet ray irradiator ("PL21-200" produced by Sen Tokushu Kogen Kabushiki Kaisha), the surface of the rubber roller spaced at 10 cm from the ultraviolet ray irradiator was irradiated with ultraviolet rays (wavelength: 184.9 nm and 253.7 nm) for five minutes in the range of 90 degrees in the circumferential direction thereof. The rubber roller was rotated by 90 degrees four times to form the oxide film on the entire peripheral surface (360 degrees) thereof.

The following characteristics of the toner transport rollers of the examples and the comparison examples obtained in the above-described method were measured.

Measurement of Surface Roughness Rz

The surface roughness Rz was measured in accordance with JIS B 0601 (1994).

Measurement of Electric Resistance of Roller

Figure 2:
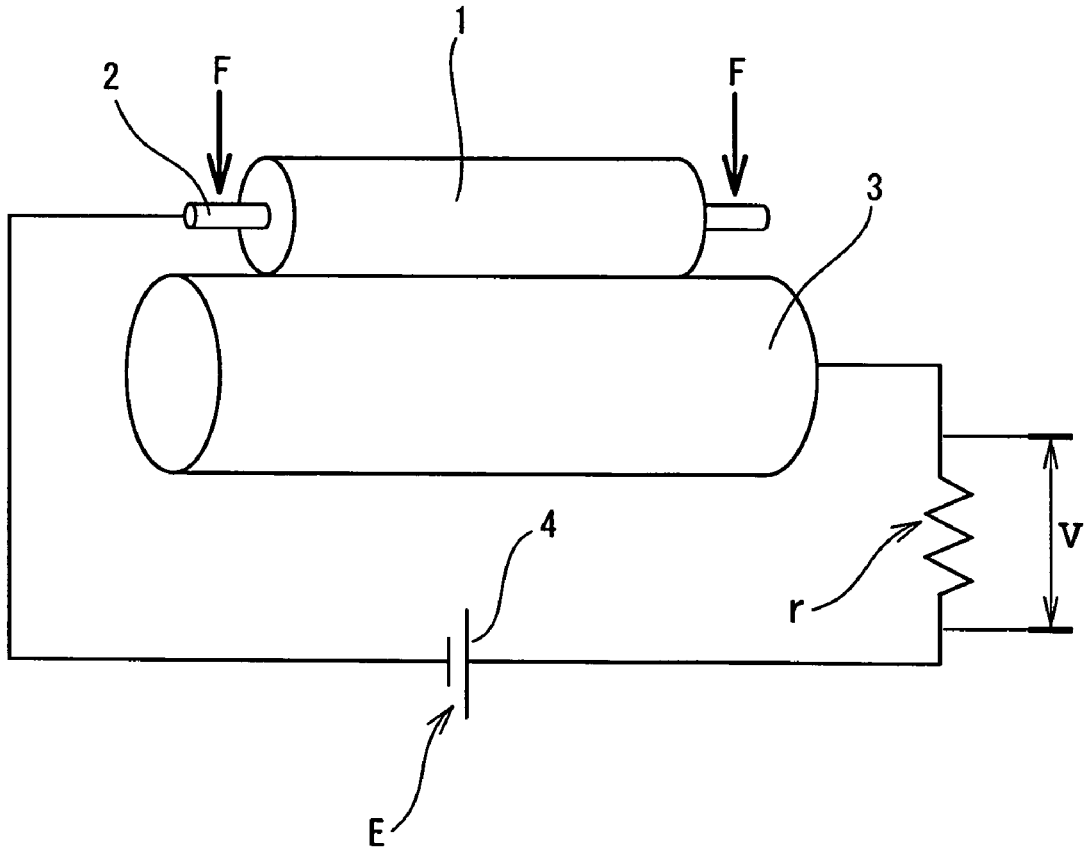
FIG. 2 shows a method of measuring the electric resistance of the toner transport roller in an embodiment of the present invention.

As shown in FIG. 2, the rubber roller 1 through which the core 2 was inserted was mounted on an aluminum drum 23, with the rubber roller 1 in contact with the aluminum drum 23. The leading end of a conductor, having an internal electric resistance of r (100Ω), connected to the positive side of a power source 24 4 was connected to one end surface of the aluminum drum 23. The leading end of the conductor connected to the negative side of the power source 24 4 was connected to one end surface of the core 2. In this condition, the circuit was energized. A load F of 500 g was applied to both ends of the core 2. The rubber roller 1 was rotated at 30 rpm. A voltage B applied to the apparatus was 500V and 100V. In these conditions, a voltage V applied to the internal electric resistance of r was measured at 100 times during four seconds. The electric resistance R was computed by using the above equation.

The electric resistance R of the rubber roller 1 is: $R=r\times E/(V-r)$. Because the term of (−r) is regarded as being slight, $R=r\times E/V$. The measurement was conducted at a constant temperature of 23° C. and a constant humidity of 55%.

Measurement of Friction Coefficient

Figure 3:
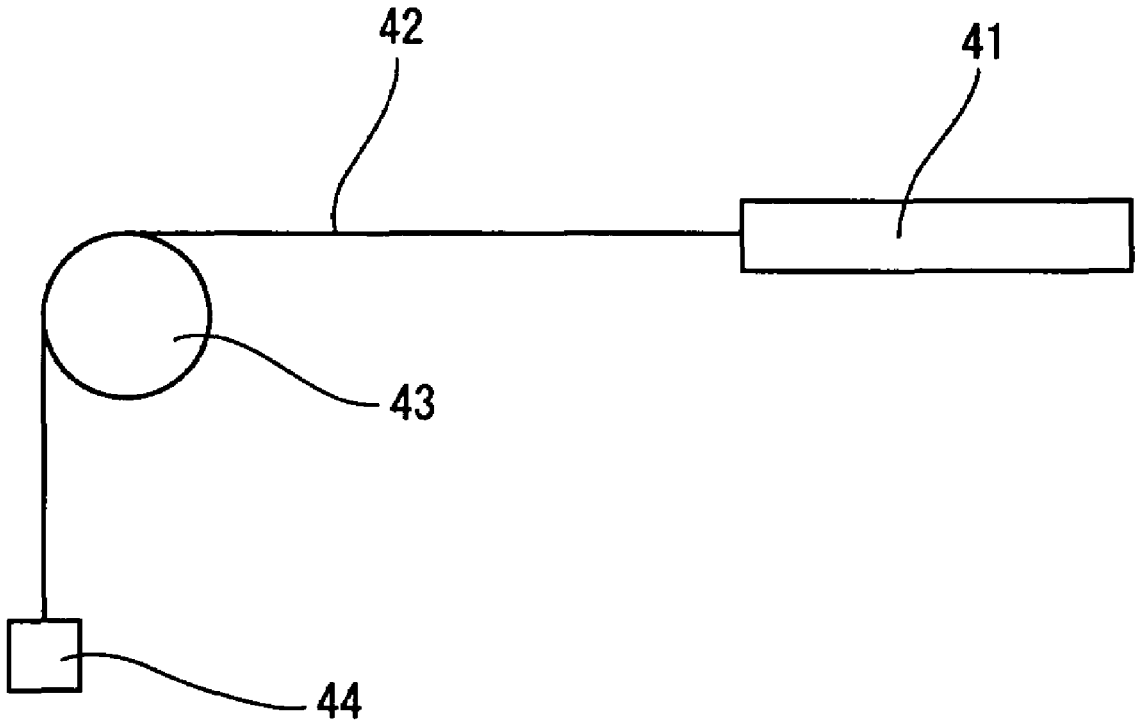
FIG. 3 shows a method of measuring the friction coefficient of the toner transport roller of the present invention.

With reference to FIG. 3, the friction coefficient of a toner transport roller 43 was measured by substituting a numerical value measured with a digital force gauge 41 of an apparatus into the Euler's equation. The apparatus has the digital force gauge ("Model PPX-2T" manufactured by Imada Inc.) 41, a friction piece (commercially available OHP film made of polyester, in contact with the toner transport roller 43 in a width of 50 mm) 42, a weight 44 having a weight of 20 g, and the toner transport roller 43.

The toner transport roller of each example and comparison example was mounted on a commercially available laser printer as its developing roller to evaluate the wearability of the sealing portion and the generation of a fogged image. The laser printer uses one-component unmagnetic toner having a positive electrostatic property.

Wearability of Sealing Portion

Printing was made by forming a 1% image on a plurality of sheets of paper. The degree of contamination of the sealing portion was checked visually each time 500 sheets of paper were printed. It was decided that the toner transport roller was worn when toner was present on a front face of the sealing portion. Table 1 shows the number of sheets of paper on which printing was made, when the toner was present on the front face of the sealing portion. The toner transport roller which was very little worn in its sealing portion and very durable (not less than 10,000 sheets of paper) was marked as ◎. The toner transport roller which was little worn in its sealing portion and durable (8,000 to 9,500 sheets of paper) was marked as ○. In the toner transport roller of the comparison examples 1 through 3, when printing was made on the number of sheets of paper shown in table 1, toner was present on the front face of the sealing portion and in addition slipped into the sealing portion.

Generation of Fogged Image

Printing was made by forming the 1% image on a plurality of sheets of paper. Each time 500 sheets of paper was printed, an image for evaluation having a portion in which a black solid and a white ground was outputted continuously. It was decided that a fogged image was formed when the white ground became dark in the output of the image for evaluation. Table 1 shows the number of sheets of paper on which printing was made, when the white ground became dark. The toner transport roller which generated the fogged image before printing was done on 6,000 sheets of paper was marked as ×, because the durability of the toner transport roller cannot be ensured. The toner transport roller which generated the fogged image when printing was done on 6,500 to 7,500 sheets of paper was marked as Δ, because the toner transport roller is not good for a practical use. The toner transport roller which generated the fogged image when printing was done on 8,000 to 9,500 sheets of paper was marked as ○, because the toner transport roller is durable. The toner transport roller which generated the fogged image after printing was done on not less than 10,000 sheets of paper was marked as ◎, because the toner transport roller is very durable.

Synthetic Evaluation

The toner transport roller of each example and comparison example was mounted on a commercially available printer using toner (life of toner: 6,000 sheets) as its developing roller to make synthetic evaluation on the wear of the sealing portion and the fogged image.

◎: The toner transport roller is very durable in a practical use and capable of keeping formation of a high-quality image for a long time.

○-◎: The toner transport roller is very durable in a practical use and capable of keeping formation of a high-quality image.

○: The toner transport roller is durable in a practical use and capable of keeping formation of a high-quality image.

Δ: The toner transport roller is not durable in a practical use. When the toner transport roller was worn, toner flowed into the sealing portion. The sealing portion was worn before the fogged image was generated.

×: The toner transport roller is unsuitable as a developing roller and cannot be practically used.

As apparent from comparison between the toner transport rollers of the examples 1 through 7 and that of the comparison example 1 and between the toner transport roller of the example 8 and that of the comparison example 2, the addition of not less than three parts by mass of alumina to the ionic-conductive rubber makes it possible to prevent the generation of the fogged image effectively, improve the wear resistance of the sealing portion, and prevent the penetration of toner into the sealing portion.

As apparent from comparison between the toner transport rollers of the examples 1 through 7 and that of the comparison example 3, it is appropriate to add 3 to 50 parts by mass of the alumina to the ionic-conductive rubber. It is preferable to add 8 to 25 parts by mass of the alumina to the ionic-conductive rubber to improve the wear resistance of the sealing portion and prevent the generation of the fogged image.

INDUSTRIAL APPLICABILITY

The toner transport roller of the present invention can be used as a developing roller, a cleaning roller, a charging roller having a cleaner, and a transfer roller for use in an image-forming apparatus.

What is claimed is:

1. A toner transport roller comprising a rubber roller and an annular sealing member, for preventing leak of toner, which slidably contacts a peripheral surface of the rubber roller, said toner transport roller containing three to 50 parts by mass of alumina for 100 parts by mass of an ionic-conductive rubber, and containing a loss tangent-adjusting filler, wherein not less than 80% of the entire alumina particles have a diameter of not more than 1 μm, and wherein the ionic-conductive rubber has a specific gravity of not less than 1.2 nor more than 1.6.

2. The toner transport roller according to claim 1, wherein said annular sealing member is slidably fined on both ends of said rubber roller in an axial direction thereof.

3. The toner transport roller according to claim 2, wherein weakly conductive carbon black or/and calcium carbonate treated with fatty acid are used as said loss tangent-adjusting filler.

4. The toner transport roller according to claim 2, wherein both an electric resistance R100 of said toner transport roller in an application of 100V and an electric resistance R500 thereof in an application of 500V are within a range of $10^5$ to $10^8\Omega$;

$$(\log R100-\log R500)<0.5;$$

a surface roughness Rz of said toner transport roller is not less than 1 μm nor more than 8 μm; and a surface friction coefficient of said toner transport roller is 0.1 to 1.5.

5. The toner transport roller, according to claim 2, which is used as a developing roller in an image-forming apparatus.

6. The toner transport roller according to claim 1, wherein weakly conductive carbon black or/and calcium carbonate treated with fatty acid are used as said loss tangent-adjusting filler.

7. The toner transport roller according to claim 6, wherein both an electric resistance R100 of said toner transport roller in an application of 100V and an electric resistance R500 thereof in an application of 500V are within a range of $10^5$ to $10^8\Omega$;

$$(\log R100-\log R500)<0.5;$$

a surface roughness Rz of said toner transport roller is not less than 1 μm nor more than 8 μm; and a surface friction coefficient of said toner transport roller is 0.1 to 1.5.

8. The toner transport roller, according to claim 6, which is used as a developing roller in an image-forming apparatus.

9. The toner transport roller according to claim 1, wherein both an electric resistance R100 of said toner transport roller in an application of 100V and an electric resistance R500 thereof in an application of 500V are within a range of $10^5$ to $10^8\Omega$;

$$(\log R100-\log R500)<0.5;$$

a surface roughness Rz of said toner transport roller is not less than 1 μm nor more than 8 μm; and a surface friction coefficient of said toner transport roller is 0.1 to 1.5.

10. The toner transport roller, according to claim 9, which is used as a developing roller in an image-forming apparatus.

11. The toner transport roller according to claim 9, wherein said loss tangent-adjusting filler is present in an amount such that the loss tangent of the rubber roller is in the range of 0.1 to 1.5 when an alternating voltage of 5V is applied thereto at a frequency of 100 Hz.

12. The toner transport roller according to claim 9, wherein the loss tangent-adjusting filler is weakly conductive carbon black present in an amount of not less than 5 nor more than 70 parts by mass for 100 parts by mass of the ionic-conductive rubber.

13. The toner transport roller according to claim 9, wherein the loss tangent-adjusting filler is weakly calcium carbonate treated with fatty acid present in an amount of not less than 30 nor more than 80 parts by mass for 100 parts by mass of the ionic-conductive rubber.

14. The toner transport roller, according to claim 1, which is used as a developing roller in an image-forming apparatus.

15. The toner transport roller according to claim 1, wherein said loss tangent-adjusting filler is present in an amount such that the loss tangent of the rubber roller is in the range of 0.1 to 1.5 when an alternating voltage of 5V is applied thereto at a frequency of 100 Hz.

16. The toner transport roller according to claim 1, wherein the loss tangent-adjusting filler is weakly conductive carbon black present in an amount of not less than 5 nor more than 70 parts by mass for 100 parts by mass of the ionic-conductive rubber.

17. The toner transport roller according to claim 1, wherein the loss tangent-adjusting filler is weakly calcium carbonate treated with fatty acid present in an amount of not less than 30 nor more than 80 parts by mass for 100 parts by mass of the ionic-conductive rubber.

* * * * *